US009385413B2

(12) United States Patent
Pass et al.

(10) Patent No.: US 9,385,413 B2
(45) Date of Patent: Jul. 5, 2016

(54) PLATFORM ASSEMBLIES FOR RADIO TRANSMISSION TOWERS

(75) Inventors: Craig T. Pass, Acworth, GA (US); Matthew J. Novis, Dallas, GA (US); Kimberly Reynolds, Dallas, GA (US)

(73) Assignee: Kenwood Telecom Corporation, Acworth, GA (US)

( * ) Notice: Subject to any disclaimer, the term of this patent is extended or adjusted under 35 U.S.C. 154(b) by 1416 days.

(21) Appl. No.: 12/887,609

(22) Filed: Sep. 22, 2010

(65) Prior Publication Data

US 2011/0279347 A1 Nov. 17, 2011

Related U.S. Application Data

(60) Provisional application No. 61/345,429, filed on May 17, 2010.

(51) Int. Cl.
*H01Q 1/12* (2006.01)

(52) U.S. Cl.
CPC ..... *H01Q 1/1242* (2013.01)

(58) Field of Classification Search
CPC ..... H01Q 1/1242
USPC ..... 52/651.1, 660, 177, 651.01, 651.02, 52/173.1; 182/129, 128, 187, 130, 222, 182/141; 343/878, 890–892; 248/218.4, 248/219.1–219.4
See application file for complete search history.

(56) References Cited

U.S. PATENT DOCUMENTS

| | | | | |
|---|---|---|---|---|
| RE20,653 | E * | 2/1938 | Lamb | 182/113 |
| 2,995,331 | A | 8/1961 | Stanton | |
| 3,996,592 | A | 12/1976 | Kline et al. | |
| 4,056,902 | A * | 11/1977 | Ziegler, Jr. | 52/73 |

(Continued)

FOREIGN PATENT DOCUMENTS

| | | |
|---|---|---|
| JP | 2001196820 | 7/2001 |
| WO | 9709499 | 3/1997 |

(Continued)

OTHER PUBLICATIONS

Pass, Craig; U.S. Provisional Application entitled: Cell Tower Platform, having U.S. Appl. No. 61/345,429, filed May 17, 2010, 25 pgs.

(Continued)

*Primary Examiner* — Daniel Cahn
(74) *Attorney, Agent, or Firm* — Taylor English Duma LLP

(57) ABSTRACT

Platform structures and platform assemblies are provided for supporting a plurality of radio frequency (RF) antennas and the weight of one or more workers. One platform structure provided herein includes a steel radial beam extending from an RF tower and a plurality of steel arms welded to the radial beam. The platform structure also includes a first front plate having a front facing portion and an angled portion, where the front facing portion of the first front plate is welded to a first steel arm. Also included is a second front plate having a front facing portion and an angled portion, where the front facing portion of the second front plate is welded to a second steel arm. The platform structure further includes a first side plate having a side facing portion and an angled portion. The side facing portion of the first side plate is welded to a third steel arm. The platform structure also includes a second side plate having a side facing portion and an angled portion, where the side facing portion of the second side plate is welded to a fourth steel arm.

16 Claims, 15 Drawing Sheets

(56) References Cited

U.S. PATENT DOCUMENTS

| | | | | | |
|---|---|---|---|---|---|
| 5,203,428 | A | * | 4/1993 | Beeche | 182/222 |
| 5,333,436 | A | | 8/1994 | Noble | |
| 5,467,955 | A | * | 11/1995 | Beyersmith | 248/219.3 |
| 5,522,186 | A | * | 6/1996 | Jarman | 52/73 |
| 5,533,304 | A | | 7/1996 | Noble | |
| 5,649,402 | A | | 7/1997 | Moore | |
| 5,787,673 | A | * | 8/1998 | Noble | 52/848 |
| 5,855,103 | A | | 1/1999 | Moore | |
| 5,872,548 | A | | 2/1999 | Lopez | |
| 5,920,291 | A | * | 7/1999 | Bosley | 343/892 |
| 5,954,305 | A | * | 9/1999 | Calabro | 248/219.4 |
| 5,999,145 | A | | 12/1999 | Niekamp | |
| 6,026,627 | A | | 2/2000 | Moore | |
| 6,028,566 | A | * | 2/2000 | Pennell et al. | 343/878 |
| 6,052,092 | A | | 4/2000 | Davis et al. | |
| 6,088,002 | A | * | 7/2000 | Johnson et al. | 343/878 |
| 6,088,003 | A | | 7/2000 | Bassirat | |
| 6,323,823 | B1 | | 11/2001 | Wong et al. | |
| 6,513,299 | B1 | | 2/2003 | Damiano | |
| 6,563,475 | B2 | * | 5/2003 | Ianello et al. | 343/890 |
| 6,612,088 | B1 | | 9/2003 | Damiano | |
| 6,710,751 | B2 | * | 3/2004 | Ianello et al. | 343/890 |
| 6,745,051 | B1 | | 6/2004 | Bassirat | |
| 2002/0053996 | A1 | * | 5/2002 | Ianello et al. | 343/890 |
| 2003/0209388 | A1 | * | 11/2003 | Arsenault et al. | 182/187 |
| 2004/0032375 | A1 | * | 2/2004 | Ianello et al. | 343/890 |

FOREIGN PATENT DOCUMENTS

| | | |
|---|---|---|
| WO | 9935707 | 7/1999 |
| WO | 0207259 | 1/2002 |

OTHER PUBLICATIONS

Kenwood Telecom; Drawings for Low Profile Co-Location Platform and Adjustable Platform Kit, publicly known prior to May 17, 2010, 2 pgs.

* cited by examiner

PLATFORM ASSEMBLIES FOR RADIO TRANSMISSION TOWERS

CROSS-REFERENCE TO RELATED APPLICATIONS

This application claims the benefit of U.S. Provisional Application No. 61/345,429, filed May 17, 2010, which is hereby incorporated by reference in its entirety herein.

TECHNICAL FIELD

The present disclosure generally relates to radio frequency (RF) antenna towers, and more particularly relates to platform assemblies supported by such towers.

BACKGROUND

Many different types of towers are in existence today, including, for example, observation towers, power transmission towers, broadcasting towers, etc. Various types of towers have been constructed for the purpose of supporting one or more antennas, such as those for broadcasting television and radio signals. In addition, some towers are specifically designed for transmitting and receiving cellular telephone signals and other types of radio frequency (RF) signals. Typically, RF towers are tall, self-supporting structures having a small base at ground level, where tubular steel monopole towers usually require a smaller area at their base than steel lattice towers. RF towers are often designed to allow a person to climb to the top to install and/or repair RF antennas (e.g., cellular antennas) connected to the towers.

SUMMARY

The present disclosure describes platform structures and platform assemblies for supporting a plurality of radio frequency (RF) antennas and the weight of one or more workers. According to one implementation, a platform structure provided as described herein includes a steel radial beam extending from an RF tower and a plurality of steel arms welded to the radial beam. The platform structure also includes a first front plate having a front facing portion and an angled portion, where the front facing portion of the first front plate is welded to a first steel arm. Also included is a second front plate having a front facing portion and an angled portion, where the front facing portion of the second front plate is welded to a second steel arm. The platform structure further includes a first side plate having a side facing portion and an angled portion. The side facing portion of the first side plate is welded to a third steel arm. The platform structure also includes a second side plate having a side facing portion and an angled portion, where the side facing portion of the second side plate is welded to a fourth steel arm.

BRIEF DESCRIPTION OF THE DRAWINGS

The features and components of the following figures are illustrated to emphasize the general principles of the present disclosure and are not necessarily drawn to scale. Corresponding features and components throughout the figures may be designated by matching reference characters for the sake of consistency and clarity.

DETAILED DESCRIPTION

Typically mounted near the tops of radio frequency (RF) towers (e.g., cellular towers) are platforms for supporting workers who may be responsible for installing and/or maintaining RF antennas (e.g., cellular antennas). The platforms are designed to support the weight of a human and may also be used to support a number of the RF antennas. The present disclosure provides platform structures and platform assemblies on which many RF antennas may be mounted. In some embodiments, the platform assemblies not only may allow the installation of up to 18 RF antennas, but also may safely support the weight of a human installing or repairing the antennas.

Figure 1A:
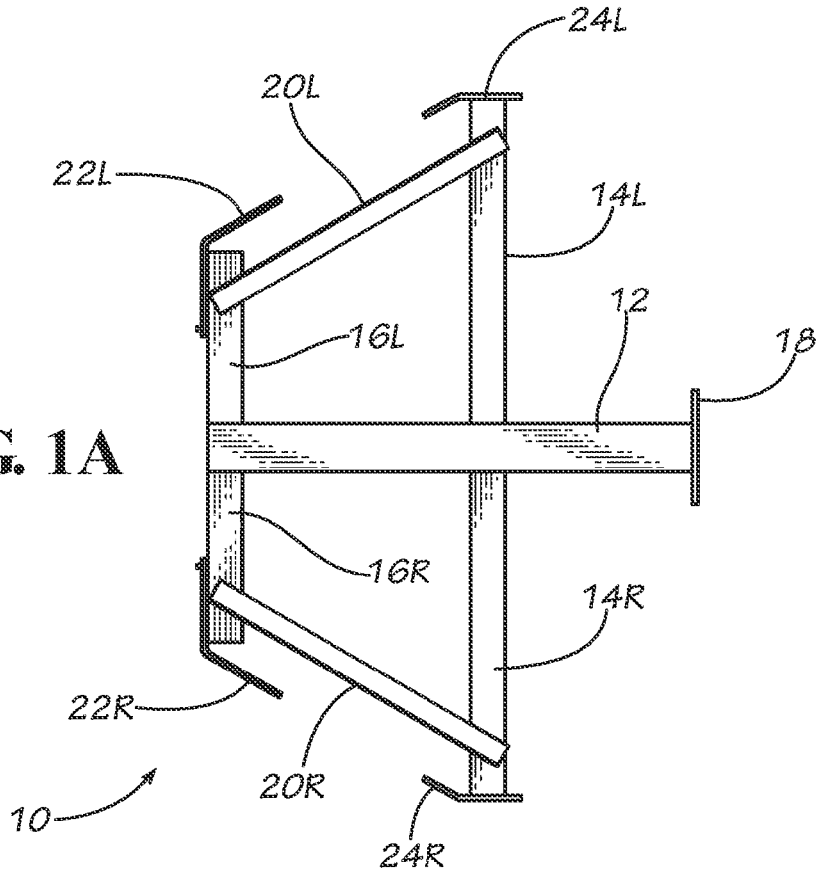
FIG. 1A is a plan view of an embodiment of a frame according to various embodiments of the present disclosure.
Figure 1B:
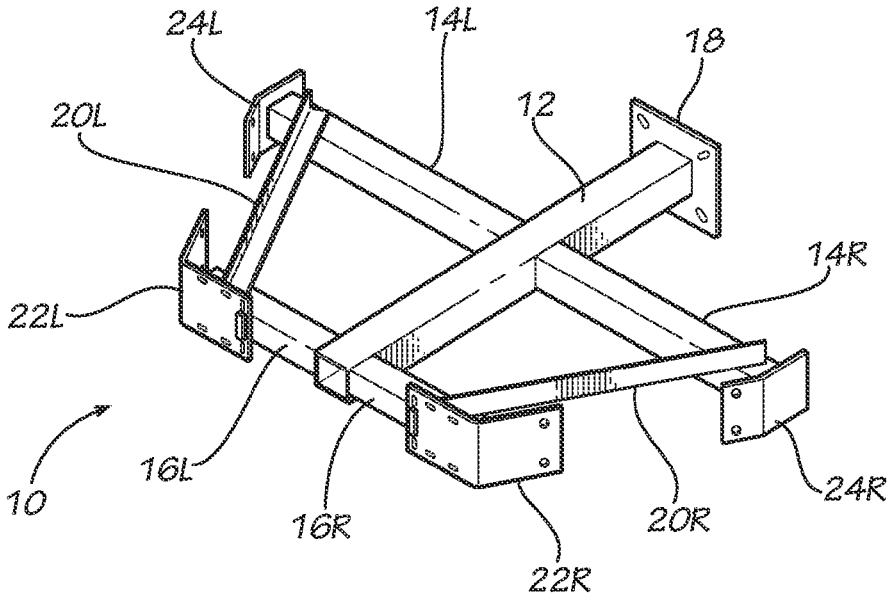
FIG. 1B is an isometric view of the frame of FIG. 1A.
Figure 1C:
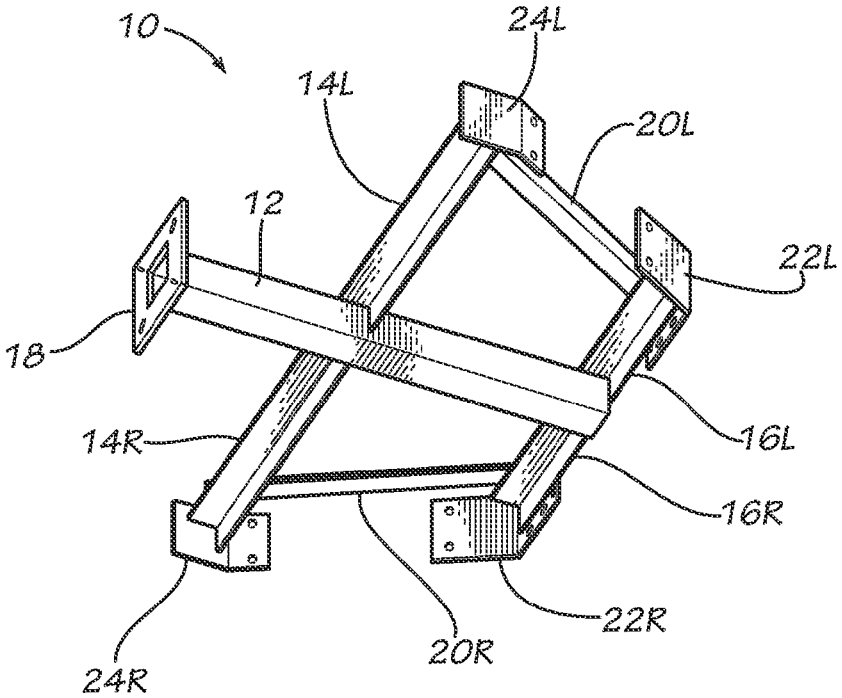
FIG. 1C is an underside view of the frame of FIG. 1A.

FIGS. 1A-1C show various views of an embodiment of a frame 10 used in construction of a platform structure. FIG. 1A is a plan view of the frame 10; FIG. 1B is an isometric view of the frame 10; and FIG. 1C is an underside view. As illustrated, the frame 10 includes a radial beam 12, back arms 14, front arms 16, and a mounting plate 18. The mounting plate 18 is configured to connect the frame 10 directly or indirectly to an RF tower (not shown). In some embodiments, the mounting plate 18 may be connected to a ring mount (e.g., T1503KT40A available from Kenwood Telecom of Acworth, Ga.) attached to a pole, monopole, or the like. In other embodiments, the mounting plate 18 may be connected to one of the tower legs of a lattice-type tower (e.g., by bolting the flanges of the mounting plate 18 to the tower legs). The mounting plate 18 is configured to support the frame 10 in such a way that the radial beam 12 extends outwardly from the RF tower in a radial manner. In this respect, the radial beam 12 is arranged horizontally, or substantially parallel with the earth's surface.

As illustrated, the radial beam 12 is configured as a hollow tube with a square cross-section. However, according to various implementations, the radial beam 12 may have any suitable configuration and/or cross-sectional shape. When configured as a hollow square tube, the radial beam 12 may include, for example, a width of about four inches, a height of about four inches, and a wall thickness of about $3/16^{th}$ of an inch.

As illustrated, the back arms 14 and front arms 16 are configured as L-beams where a first portion of the L-beam is arranged substantially in the same plane as a top surface of the radial beam 12 and a second portion extends downward substantially perpendicular to the plane of the top surface of the radial beam 12 and/or substantially perpendicular to side surfaces of the radial beam 12. In some embodiments, the first portion of the L-beams of the back arms 14 and front arms 16 may be positioned such that a top surface of the first portion is both parallel with and slightly offset from (e.g., above or below) the top surface of the radial beam 12. Each of the back arms 14 may be constructed to be longer than each of the front arms 16. The back arms 14 and front arms 16 may be fastened to the radial beam 12 by welding (e.g., using ¼ inch fillet welds).

The frame 10 also includes grating supports 20. A left grating support 20L is fastened at one of its ends to the top of the left back arm 14L and at its other end to the top of the left front arm 16L. A right grating support 20R is fastened at one of its ends to the top of the right back arm 14R and at its other end to the top of the right front arms 16R. The grating supports 20 may be configured as L-beams and welded (e.g., using ¼ inch fillet welds) to the back arms 14 and front arms 16. The grating supports 20 may be arranged at angles, as shown, to conform to the general shape and/or angles of a grating screen.

The frame 10 also includes a pair of front plates 22 and a pair of side plates 24. The two front plates 22 on opposite sides are mirror images of each other and the two side plates 24 on opposite sides are also mirror images of each other. The front plates 22 and side plates 24 are fastened to the respective arms 14, 16, such as by welding (e.g., using ¼ inch fillet welds). The right front plate 22R is fastened to the right front arm 16R and the left front plate 22L is fastened to the left front arm 16L. A front facing portion of each front plate 22 is fastened to a front portion of the respective front arm 16 and an angled portion of each front plate 22 is oriented at an acute angle. The right side plate 24R is fastened to the right back arm 14R and the left side plate 24L is fastened to the left back arm 14L. A side facing portion of each side plate 24 is fastened to an end portion of the respective back arm 14 and an angled portion of each side plate 22 is oriented at an acute angle. The angled portion of the front plate 22 on each respective side may be arranged in the same geometric plane with the angled portion of the respective side plate 24, thereby allowing an element having a straight edge to abut both plates. The front plates 22 and side plates 24 are described in more detail with respect to FIG. 4.

The different components of the frame 10 may be welded together to form a unitary rigid construction. The frame 10 may be constructed using any suitable material, such as hot dipped galvanized steel. According to alternative embodiments, the platform assembly 26 may be formed from fiber-reinforced plastic (i.e., FRP or fiberglass), an ultraviolet stable composition, grade 6061 aluminum, or other suitable material. In some embodiments, the material of the frame 10 may naturally minimize rusting and does not require a finish.

Figure 2A:
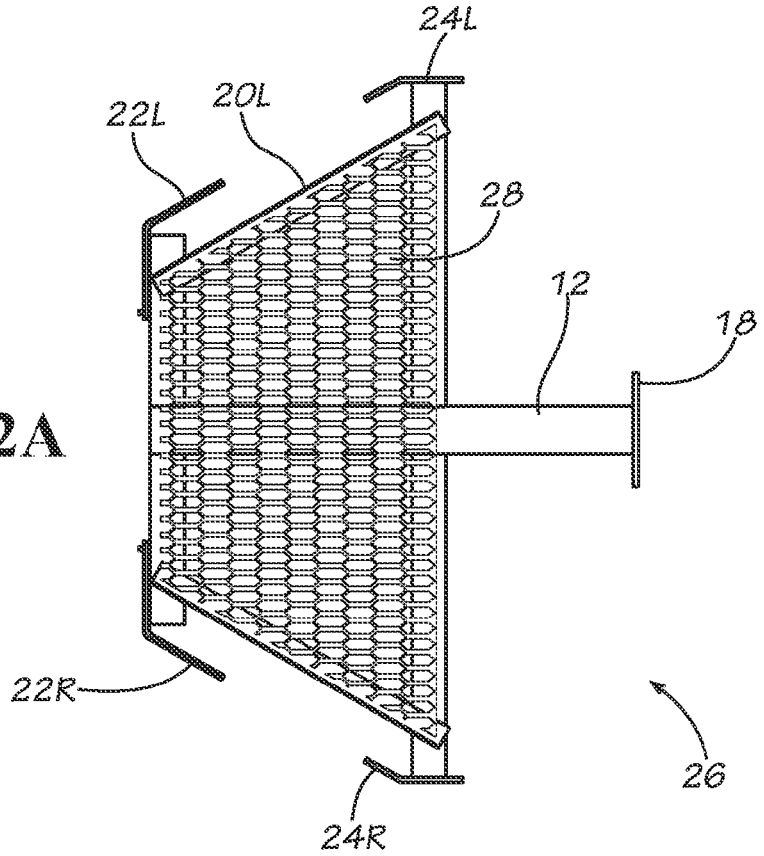
FIG. 2A is a plan view of an embodiment of a platform structure according to various embodiments.
Figure 2B:
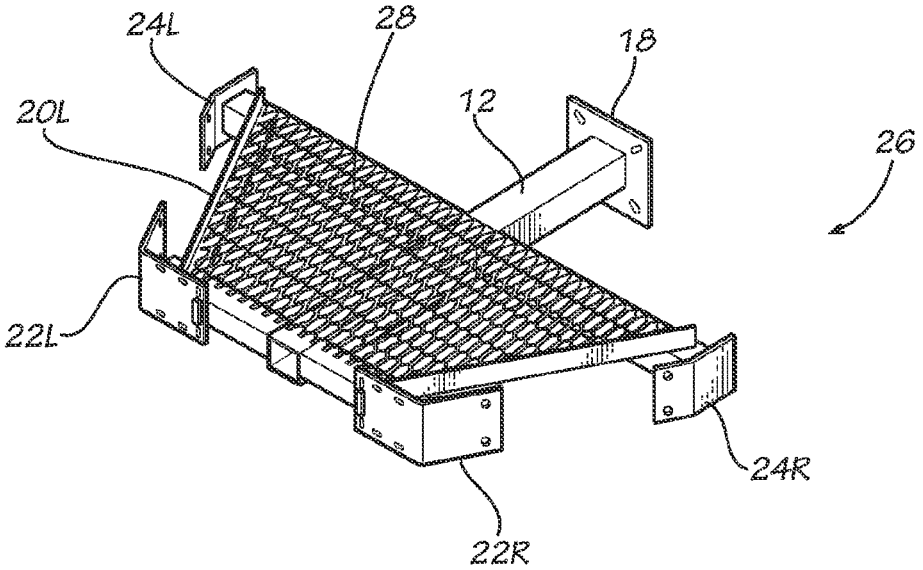
FIG. 2B is an isometric view of the platform structure shown in FIG. 2A.
Figure 2C:
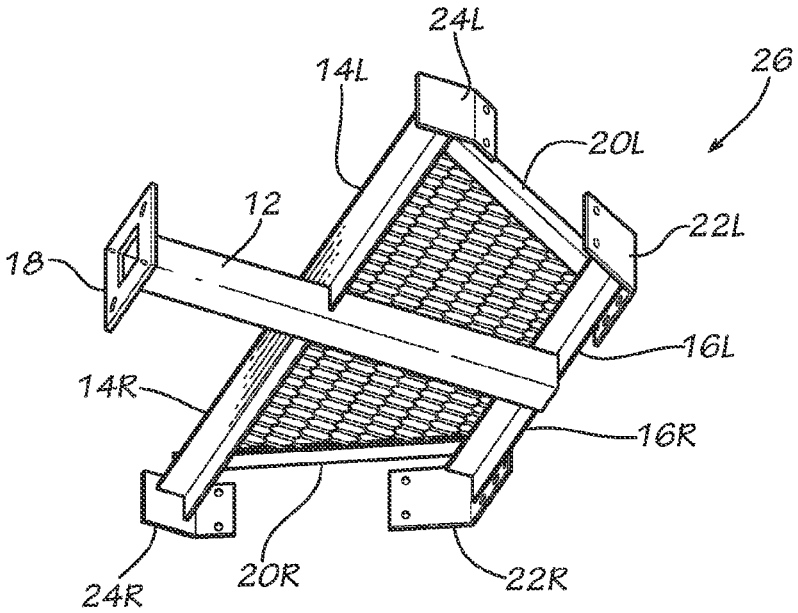
FIG. 2C is an underside view of the platform structure shown in FIG. 2A.

FIGS. 2A-2C show views of a platform structure 26 according to various implementations of the present disclosure. FIG. 2A is a plan view of the platform structure 26; FIG. 2B is an isometric view of the platform structure 26; and FIG. 2C is an underside view. As illustrated, the platform assembly 26 includes the frame 10, described with respect to FIG. 1, and a grating 28 in place on top of the frame 10. The grating 28 may be supported by the grating supports 20 and in some embodiments may also be supported by the radial beam 12 and/or back arms 14 and front arms 16. The grating 28 is fastened to the frame 10, such as by 3/16 inch stitch welds. The grating 28 may have a trapezoidal shape as shown or may be configured in any other shape depending on the design of the frame 10. The platform assembly 26 may have any suitable dimensions to safely support one or more people, depending on the particular design, and a number of antennas having adequate spacing between the antennas. According to various embodiments, the platform assembly 26 may be configured to have width of about 62 inches and a depth of about 43 inches.

Figure 3:
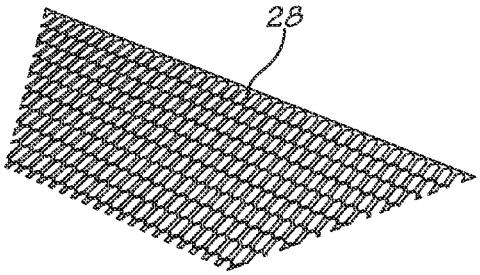
FIG. 3 is an isometric view of the grating shown in FIGS. 2A-2C, according to various embodiments.

FIG. 3 is an isometric view of the grating 28 shown in FIG. 2, according to various embodiments. The grating 28 may be configured as a steel mesh or other material having sufficient strength to support a worker and providing good traction to minimize slippage.

Figure 4:
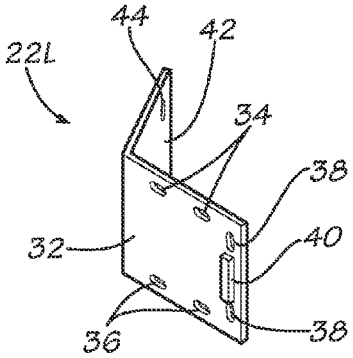
FIG. 4 is an isometric view of one of the front plates shown in FIGS. 1A-1C and 2A-2C, according to various embodiments.

FIG. 4 is an isometric view of the left front plate 22L shown in FIGS. 1A-1C and 2A-2C, according to various embodiments. It should be noted that the right front plate 22R may be configured as a mirror-image version of the left front plate 22L. The left front plate 22L is configured for connection to the left front arm 16L and the mirror-image right front plate 22R is configured for connection to the right front arm 16R. A front portion 32 of the front plate 22 has a front facing surface and a back facing surface. The back facing surface is fastened (e.g., welded with a ¼ inch fillet weld) to a front-facing portion of the front arm 16. The front portion 32 includes a top pair of apertures 34, a bottom pair of apertures 36, a side pair of apertures 38, and a standoff 40. Ends of a U-bolt may be inserted through an aperture pair, and a pair of hex nuts (with or without washers) may engage the U-bolt ends to hold a cylindrical pipe. In order to allow the ends of the U-bolts be inserted through the apertures, the distance between the side pair of apertures 38 is configured to be greater than the height of the front arm 16 and the front plate 22 is fastened to the front arms 16 so as not to block the apertures. An angled portion 42 of the front plate 22 also includes a pair of apertures 44. In addition to the front plates 22, the frame 10 also includes side plates 24. Referring back to FIG. 1, the back arms 14 are configured to support the side plates 24, such as by welding. The side plates 24 include an angled portion substantially in the same plane as the angled portion 42 of the front plate 22 when both are fastened to the respective arms. The angled portion of the side plates 24 may also include a pair of apertures, which may be configured to accept a U-bolt.

Figure 5A:
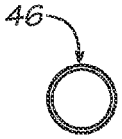
FIG. 5A is an end view of a pipe for supporting antenna supports, according to various embodiments.
Figure 5B:
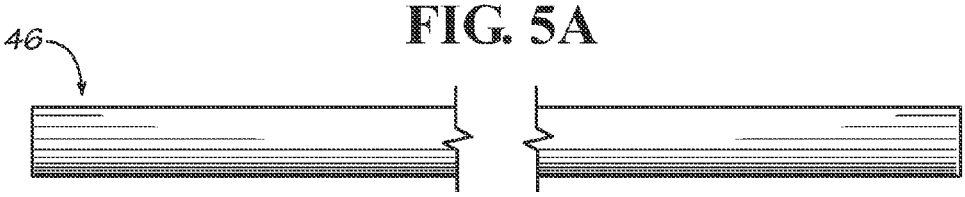
FIG. 5B is a side view of the pipe of FIG. 5A.

FIGS. 5A and 5B are views of a pipe 46 used in the construction of a platform assembly. FIG. 5A is an end view of the pipe 46 and FIG. 5B is a side view of the pipe 46. Various lengths of the pipe 46 may be used as front pipes 46-F and side pipes 46-S as described in more detail below. In some embodiments, the pipe 46 may have a circular cross-section as shown or in other embodiments may have any other suitable cross-section. U-bolts and other hardware, such as washers and hex nuts, may be used for fastening the pipes 46 to the platform structures 26 to create platform assemblies. According to some embodiments, the diameter of the pipe 46 may be 3.50 inches.

FIGS. 6A through 6E are diagrams showing several configurations for connecting the pipes 46 to the front plates 22 and/or side plates 24 and various configuration for connecting antenna supports 56 to the pipes 46 and/or to the front plates 22, according to various embodiments. Connections are shown in these embodiments using U-bolts having hex nuts and washers engaged with the ends of the U-bolts. It should be understood that other types of connectors (e.g., permanent or removable) can be used for the purpose of securing the various elements together. One advantage of removable connectors is that the antennas can be configured in many different arrangements depending on the particular need. If the needs change, the arrangements may be changed as well.

Figure 6A:
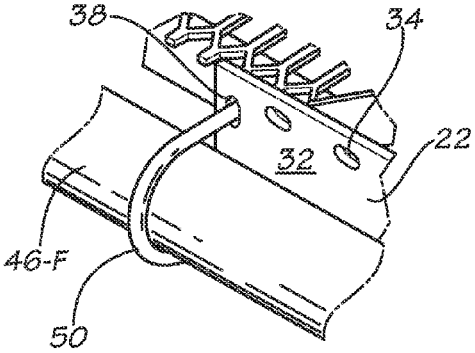
FIGS. 6A through 6E are diagrams of attachment configurations according to various embodiments.
Figure 6B:
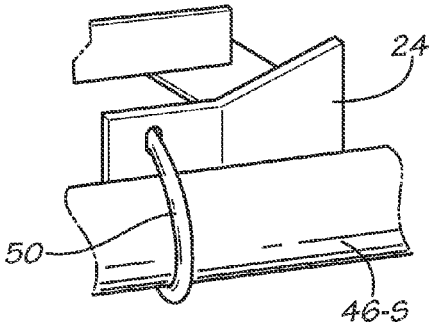
Figure 6C:
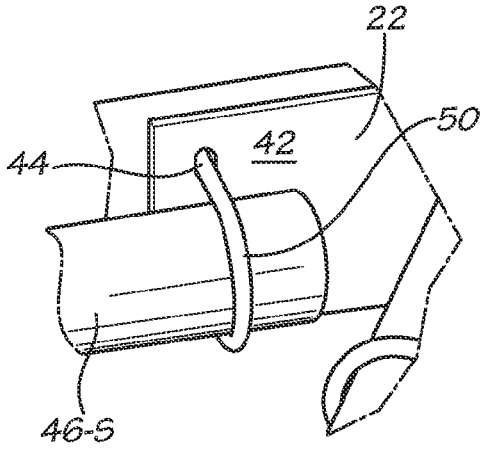

FIG. 6A shows a front pipe 46-F connected to a front plate 22. A U-bolt 50 is placed around the front pipe 46-F and has its ends inserted through the pair of apertures 38 on the front facing portion 32 of the front plate 22. FIG. 6B shows a side pipe 46-S connected to a side plate 24. A U-bolt 50 is placed around the side pipe 46-S and has its ends inserted through the pair of apertures on the angled portion of the side plate 24. FIG. 6C shows a side pipe 46-S connected to a front plate 22. A U-bolt 50 is placed around the side pipe 46-S and has its ends inserted through the pair of apertures 44 on the side facing portion 42 of the front plate 22.

Figure 6D:
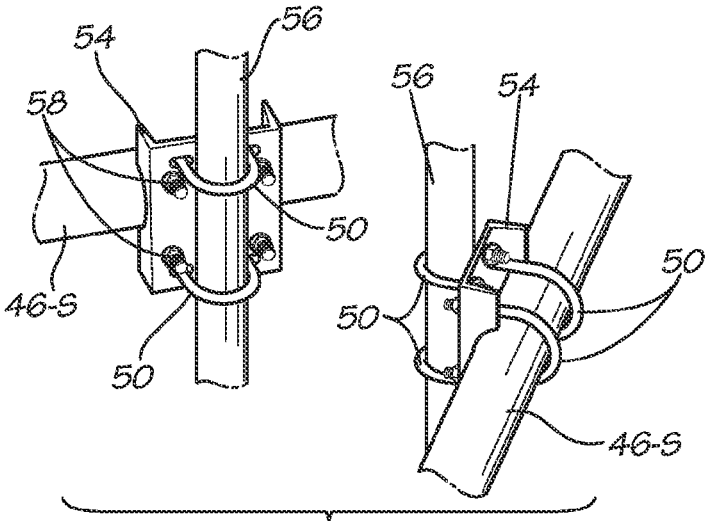
Figure 6E:
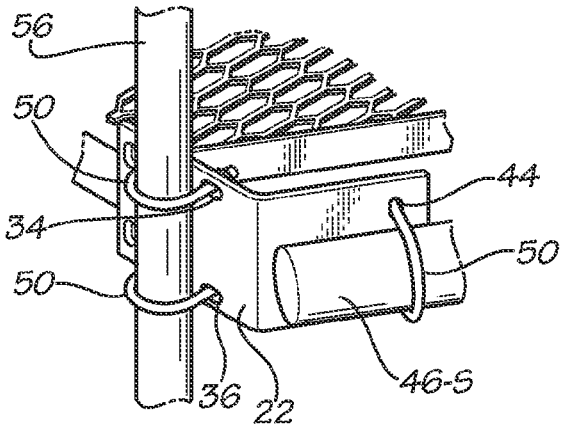

FIG. 6D shows an antenna support 56 connected to a side pipe 46-S. A first set of U-bolts 50 is placed around the side pipe 46-S and the ends of the U-bolts 50 are inserted through apertures in mounting hardware 54. The mounting hardware 54 can be positioned with its flat side arranged vertically and with a pair of semi-circular openings in side flanges arranged partially around the side pipe 46-S. An antenna support 56 is connected to the mounting hardware 54 using a second set of U-bolts. FIG. 6E shows an embodiment in which an antenna support 56 is connected without the use of a horizontally oriented pipe 46. Instead, the antenna support 56 is this implementation is connected directly to the front plate 22 using U-bolts 50 inserted through the top pair of apertures 34 and the bottom pair of apertures 36 on the front facing portion 32 of the front plate 22.

According to various implementations, the platform structure 26 is configured to support the weight of a human and multiple RF antennas. The platform structure 26 may comprise a radial beam 12 having a middle section, a first end, and a second end. The radial beam 12 is configured to extend substantially horizontally away from a vertical support structure (e.g., a cell tower). The platform structure 26 also includes a mounting plate 18 fastened to the first end of the radial beam 12 and configured to be connected to the vertical support structure.

The platform structure 26 also includes a first back arm 14L having a first end and a second end, where the first end of the first back arm 14L is fastened to a first side of the middle section of the radial beam 12, the first back arm 14L extending substantially horizontally away from the radial beam 12. Also included is a second back arm 14R having a first end and a second end, the first end of the second back arm 14R being fastened to a second side of the middle section of the radial beam 12, the second back arm 14R extending substantially horizontally away from the radial beam 12. The platform structure 26 also includes a first front arm 16L having a first end and a second end, the first end of the first front arm 16L being fastened to a first side of the second end of the radial beam 12. The first front arm 16L is configured to extend substantially horizontally away from the radial beam 12. A second front arm 16R is also provided having a first end and a second end. The first end of the second front arm 16R is fastened to a second side of the second end of the radial beam 12. The second front arm 16R extends substantially horizontally away from the radial beam 12.

The platform structure 26 also includes a first grating support 20L having a first end and a second end. The first end of the first grating support 20L is fastened to a top portion of the second end of the first back arm 14L and the second end of the first grating support 20L is fastened to a top portion of the second end of the first front arm 16L. A second grating support 20R is provided having a first end and a second end, the first end being fastened to a top portion of the second end of the second back arm 14R and the second end being fastened to a top portion of the second end of the second front arm 16R. A grating is fastened to the first grating support 20L and the second grating support 20R.

A first front plate 22L having a front facing portion 32 and an angled portion 42 is also provided. The front facing portion 32 of the first front plate 22L is fastened to a side portion of the second end of the first front arm 16L. A second front plate 22R having a front facing portion 32 and an angled portion 42 is also provided, where the front facing portion 32 is fastened to a side portion of the second end of the second front arm 16R. The platform structure 26 also includes a first side plate 24L having a side facing portion and an angled portion. The side facing portion of the first side plate 24L is fastened to an end portion of the second end of the first back arm 14L. A second side plate 24R having a side facing portion and an angled portion is also provided. The side facing portion of the second side plate 24R is fastened to an end portion of the second end of the second back arm 14R.

The angled portion 42 of the first front plate 22L and the angled portion of the first side plate 24L may be arranged substantially in a first geometric plane, and the angled portion 42 of the second front plate 22R and the angled portion of the second side plate 24R may be arranged substantially in a second geometric plane. A first side pipe 46-S having a first end and a second end may be configured with its first end connected to the angled portion 42 of the first front plate 22L and the angled portion of the first side plate 24L. A second side pipe 46-S having a first end and a second end may be configured with its first end connected to the angled portion 42 of the second front plate 22R and the angled portion of the second side plate 24R. The second end of the first side pipe 46-S may be connected to a second platform structure 26 and the second end of the second side pipe 46-S may be connected to a third platform structure 26. Multiple antenna supports 56 may be configured to be connected to each of the first and second side pipe 46-S. The antenna supports 56 may be arranged in a substantially vertical configuration, each antenna support 56 configured to support an RF antenna.

The front facing portion 32 of the first front plate 22L and the front facing portion 32 of the second front plate 22R are arranged substantially in a geometric plane. A front pipe 46-F may be connected to the first and second front plates 22. Multiple antenna supports 56 may be configured to be connected to the front pipe 46-F, where the antenna supports 56 may be arranged in a substantially vertical configuration.

The platform structure 26 may have a first antenna support 56 connected to the front facing portion 32 of the first front plate 22L and a second antenna support 56 connected to the front facing portion 32 of the second front plate 22L. The first and second antenna supports 56 may be arranged in a substantially vertical configuration and each antenna support 56 may be configured to support an RF antenna. The vertical support structure, for example, may be a tower. The elements of the platform structure may be fastened to each other by welding.

According to some embodiments, the platform structure 26 may comprise a steel radial beam 12 extending from a cell tower and a plurality of steel arms 14 and 16 welded to the radial beam 12. A first front plate 22L may have a front facing portion 32 and an angled portion 42, the front facing portion 32 being welded to a first steel arm 16L. A second front plate 22R may have a front facing portion 32 and an angled portion 42, the front facing portion 32 being welded to a second steel arm 16R. The platform structure 26 in this implementation may also include a first side plate 24L having a side facing portion and an angled portion, the side facing portion of the first side plate 24L being welded to a third steel arm 14L. A second side plate 24R may have a side facing portion and an angled portion, where the side facing portion is welded to a fourth steel arm 14R.

The platform structure 26 may further comprise a grating 28 supported by the radial beam 12, where the grating 28 is configured to support the weight of a human. The angled portion 42 of the first front plate 22L and the angled portion of the first side plate 24L may be arranged substantially in a first geometric plane and are configured to support a first end of a first side pipe 46-S. The angled portion 42 of the second front plate 22R and the angled portion of the second side plate 24R are arranged substantially in a second geometric plane and are configured to support a first end of a second side pipe 46-S. The second end of the first side pipe 46-S may be connected to a second platform structure 26 and the second end of the second side pipe 46-S may be connected to a third platform structure 26. Three antenna supports 56 may be connected to each of the first side pipe 46-S and second side pipe 46-S. The antenna supports 56 may be arranged in a substantially vertical configuration, where each antenna support 56 is configured to support an RF antenna.

The front facing portion 32 of the first front plate 22L and the front facing portion 32 of the second front plate 22R may be arranged substantially in a geometric plane. A front pipe 46-F may be connected to the first front plate 22 and the second front plate 22. Three antenna supports 56 may be connected to the front pipe 46-F, arranged in a substantially vertical configuration, where each antenna support 56 is configured to support an RF antenna. According to other embodiments, a first antenna support 56 may be connected directly to the front facing portion 32 of the first front plate 22L and a second antenna support 56 may be connected directly to the front facing portion 32 of the second front plate 22R, where the first and second antenna supports 56 may be arranged in a substantially vertical configuration.

The platform structures 26, pipes 46, antenna supports 56, and various hardware components (e.g., U-bolts, hex nuts, mounting brackets, etc.), as described above, may be connected in various ways to form many different arrangement, depending on the particular need. Non-limiting examples of assembled products, referred to herein as "platform assemblies," are described below with respect to FIGS. 7-14. It should be noted that the number of antenna supports 56 shown along a particular side of the platform assemblies may be a maximum number recommended for the side, but, in some embodiments, fewer or more antenna supports 56 may be connected than shown.

Figure 7A:
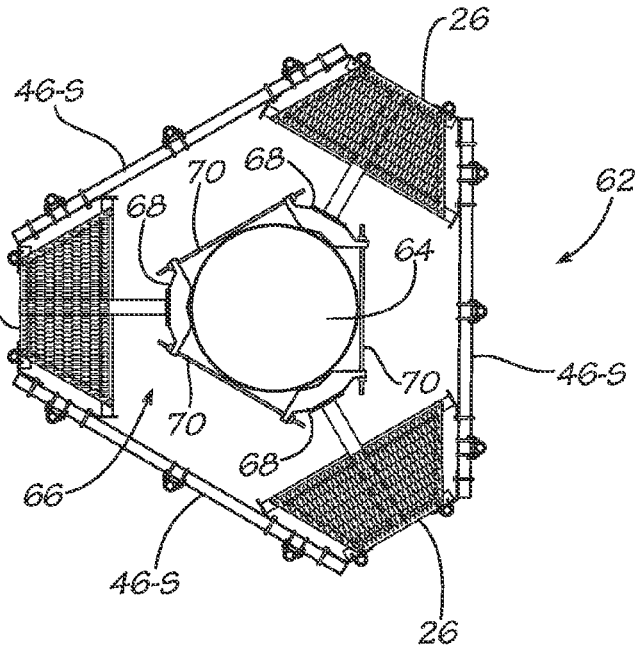
FIGS. 7A and 7B are diagrams of a first platform assembly according to various embodiments.
Figure 7B:
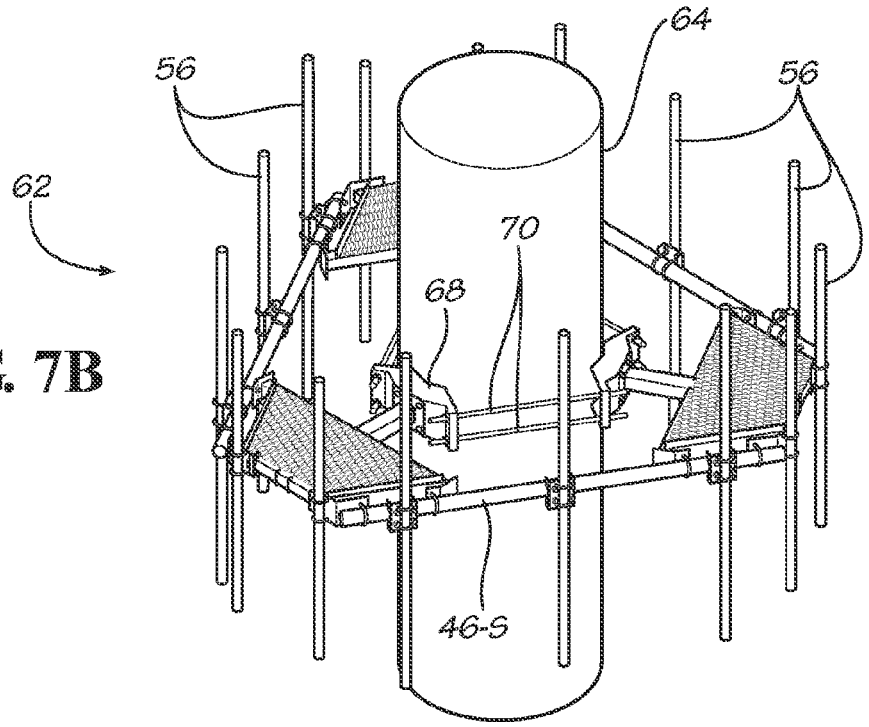

FIGS. 7A and 7B are diagrams of a first embodiment of a platform assembly 62. FIG. 7A is a plan view of the platform assembly 62 and FIG. 7B is an isometric view. In this embodiment, the platform assembly 62 includes three platform structures 26 arranged around the outside of a vertical support structure 64 or other tower structure (e.g., a monopole). As illustrated, the platform assembly 62 is secured to the vertical support structure 64 by a brace structure 66, ring mount, or other suitable type brace. According to some implementations, the brace structure 66 may comprise a beam support element 68 and bolts 70. The beam support element 68 may be configured to connect to mounting plate 18 (FIGS. 1 and 2) of the frame 10 using any suitable hardware or by other means. The brace structure 66 may be configured to support the platform assembly 26 in a substantially horizontal manner with the radial beam 12 arranged substantially radially from the vertical support structure 64. The brace structure 66 may be configured to support the platform structures 26 in an arrangement equally spaced around the pole 48 and at equal angles (e.g., 120°) from each other.

The platform assembly 62 also includes three side pipes 46-S and up to three antenna supports 56 connected to each of the side pipes 46-S. The platform assembly 62 also includes up to two antenna supports 56 connected to each short side of the platform assembly 62. More particularly, each platform structure 26 may receive one antenna support 56 on the front facing portion 32 of the left front plate 22L and another antenna support 56 on the front facing portion 32 of the right front plate 22R. In this arrangement, the platform assembly 62 may support a total of up to fifteen antenna supports 56, each of which may in turn support one RF antenna. The antenna supports 56 may be mounted to the side pipes 46-S using mounting hardware 54 as shown in the configuration of FIG. 6D. U-bolts and hex nuts may be used to connect the mounting hardware 54 to both the respective side pipe 46-S and antenna support 56.

In the embodiment of FIG. 7 (FIGS. 7A & 7B), the platform assembly 62 is configured without front pipes 46-F (FIG. 6A), without which two antenna supports 56 may be mounted directly to each of the platform structures 26. For example, the antenna supports 56 may be held in place by two U-bolts 50 as shown in FIG. 6E. The ends of a first U-bolt 50 may be inserted through the top aperture pair 34 of the front plate 22 and engaged with hex nuts (not shown) and the ends of a second U-bolt 50 may be inserted through the bottom aperture pair 36 of the front plate 22 and engages with hex nuts.

Figure 8A:
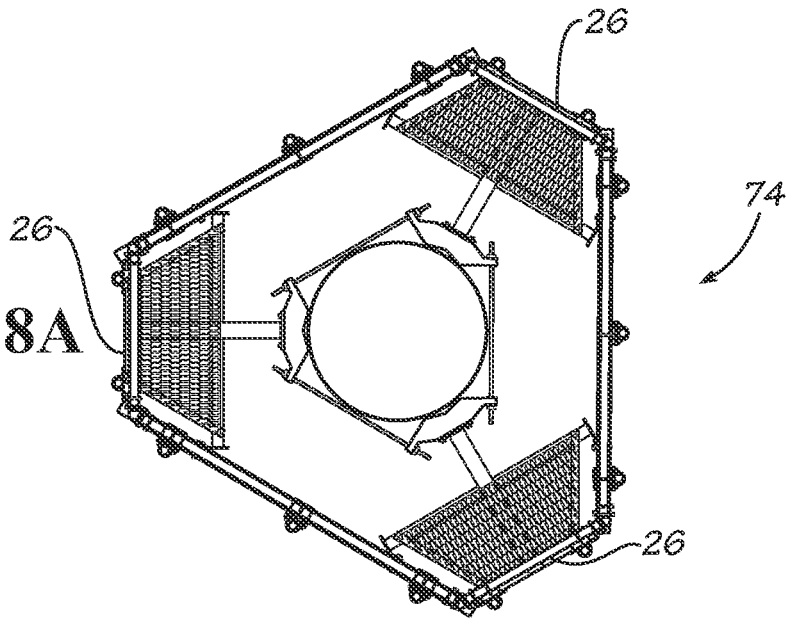
FIGS. 8A and 8B are diagrams of a second platform assembly according to various embodiments.
Figure 8B:
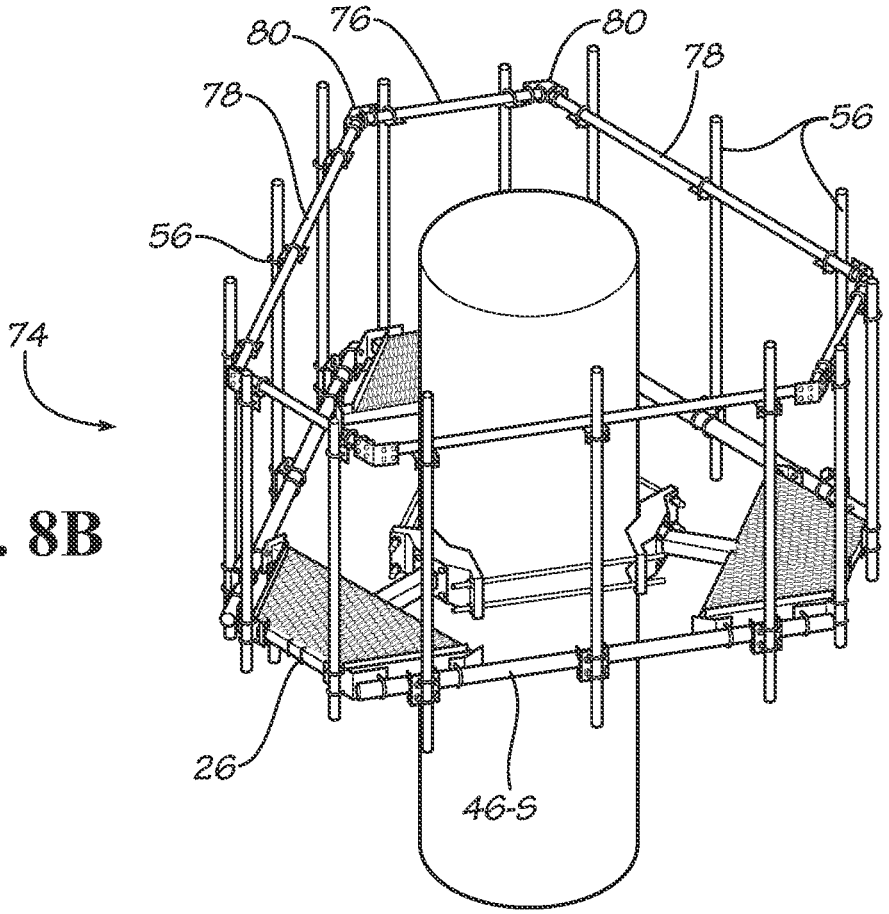

FIGS. 8A and 8B are diagrams of a second embodiment of a platform assembly 74, where FIG. 8A is a plan view and FIG. 8B is an isometric view. The arrangement of side pipes 46-S may be similar to the embodiment of FIGS. 7A and 7B. However, the platform assembly 74 is further configured such that the antenna supports 56 are mounted higher with respect to the top surface of the platform structures 26. The antenna supports 56 are connected to the platform structures 26 and side pipes 46-S near a bottom end of the antenna supports 56. Near a top end of the antenna supports 56, front handrails 76 and side handrails 78 may be connected, using, for example as shown, handrail support hardware with an angled bracket connected with U-bolts and hex nuts to the antenna supports 56 and handrails 76, 78. Also, each front handrail 76 may be connected to adjacent side handrails 78 by handrail mounting plates 80. The handrail mounting plates 80 may be connected at an inside angle or outside angle of the intersection of the front handrails 76 and side handrails 78. The handrail mounting plates 80 may be configured as an angled plate with aperture pairs formed therein to accommodate U-bolts.

Figure 9A:
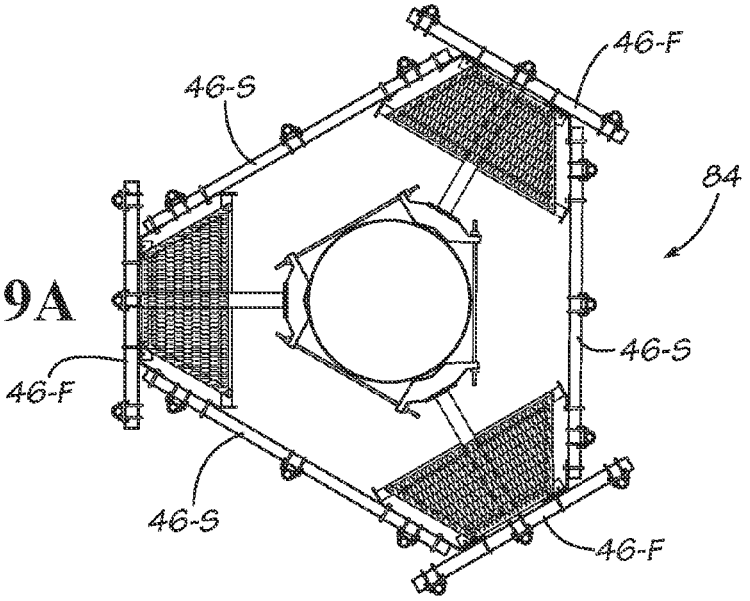
FIGS. 9A and 9B are diagrams of a third platform assembly according to various embodiments.
Figure 9B:
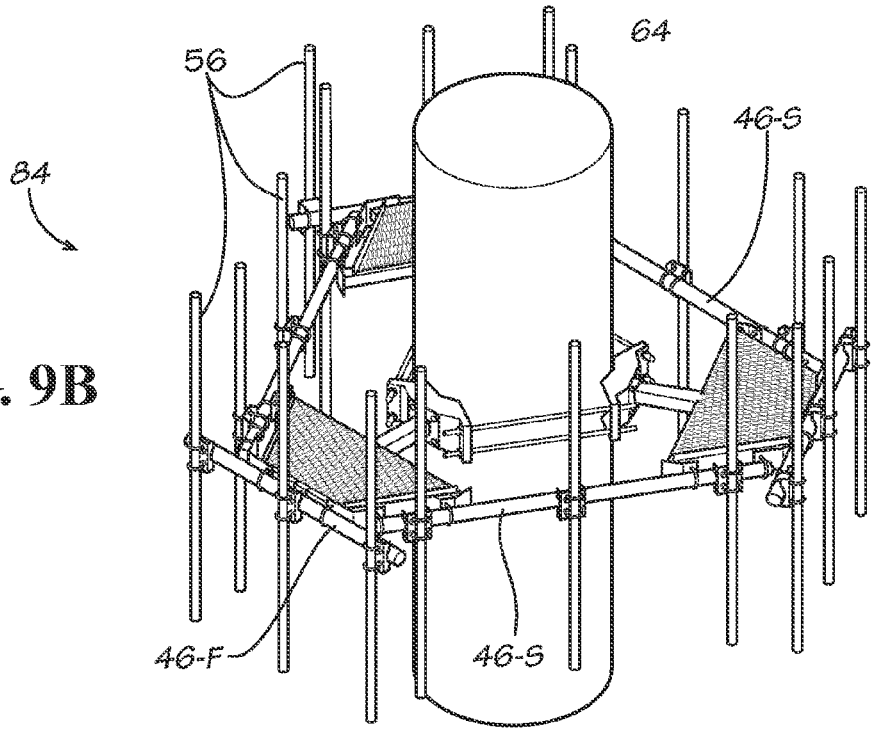

FIGS. 9A and 9B are diagrams of a third embodiment of a platform assembly 84. The platform assembly 84 of FIG. 9 includes three platform structures 26. Each of the three platform structures 26 is configured to support a front pipe 46-F. The front pipe 46-F may be connected to the respective platform assembly 84 using a U-bolt 50 surrounding the front pipe 46-F and inserted through the side aperture pair 38 as shown in FIG. 6A. In addition, three side pipes 46-S are supported at a first end by a first platform assembly 26 and at a second end by a second platform assembly 26. At each end of the side pipe 46-S, a first U-bolt 50 may be arranged in the aperture pair 44 in the angled portion of the side plate 24 to hold the side pipe 46-S as shown in FIG. 6B and a second U-bolt 50 may be arranged in the aperture pair 44 in the side portion 42 of the front plate 22 as shown in FIG. 6C.

Any number of antenna supports 56 may be mounted to the front pipes 46-F and side pipes 46-S. Each of the antenna supports 56 is configured to support one RF antenna (not shown) of an array. The antennas may include any suitable type of RF antenna and may include complementary hardware for connecting the antennas to the antenna supports 56. As shown in FIG. 9, the platform assembly 84 is arranged with three front pipes 46-F, three side pipes 46-S, and three antenna supports 56 connected to each of the front pipes 46-F and side pipes 46-S. In this arrangement, the platform assembly 84 may support a total of eighteen antennas.

Figure 10A:
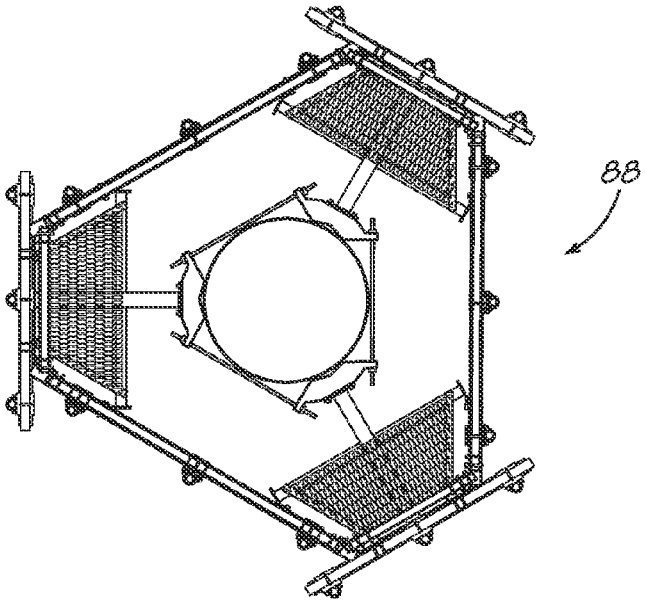
FIGS. 10A and 10B are diagrams of a fourth platform assembly according to various embodiments.
Figure 10B:
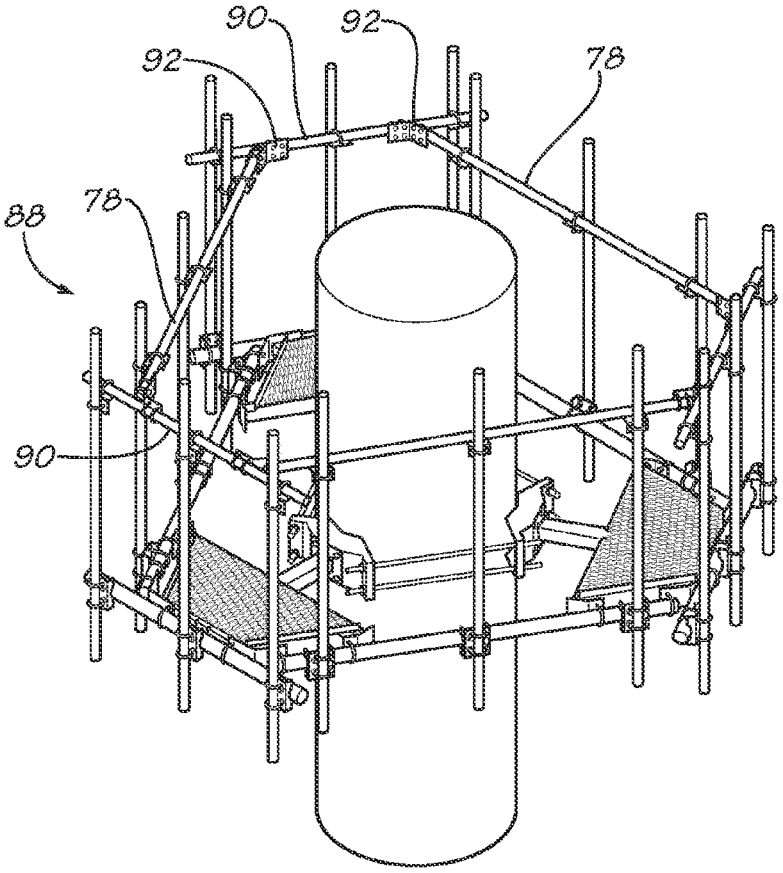

FIGS. 10A and 10B are diagrams of a fourth embodiment of a platform assembly 88. The arrangement of front pipes 46-F and side pipes 46-S may be similar to the embodiment of FIGS. 9A and 9B. However, the platform assembly 88 is further configured such that the antenna supports 56 are mounted at a higher level. Bottom ends of the antenna supports 56 are connected to the front pipes 46-F and side pipes 46-S and top ends of the antenna supports 56 are connected to front handrails 90 and side handrails 78. The front handrails 90 and side handrails 78 may be connected to the antenna supports 56, using, for example, handrail support hardware. Also, each front handrail 90 may be connected to adjacent side handrails 78 using handrail plates 92. The handrail plates 92 may be configured as an angled plate with aperture pairs formed therein to accommodate U-bolts.

Figure 11A:
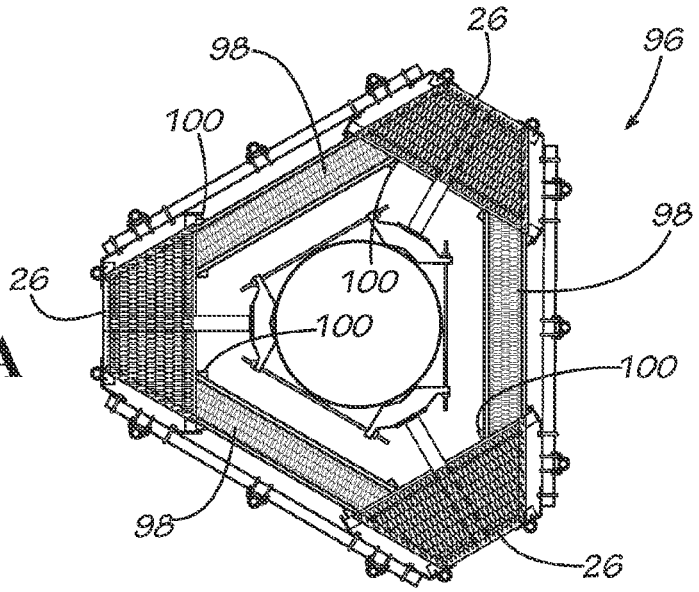
FIGS. 11A and 11B are diagrams of a fifth platform assembly according to various embodiments.
Figure 11B:
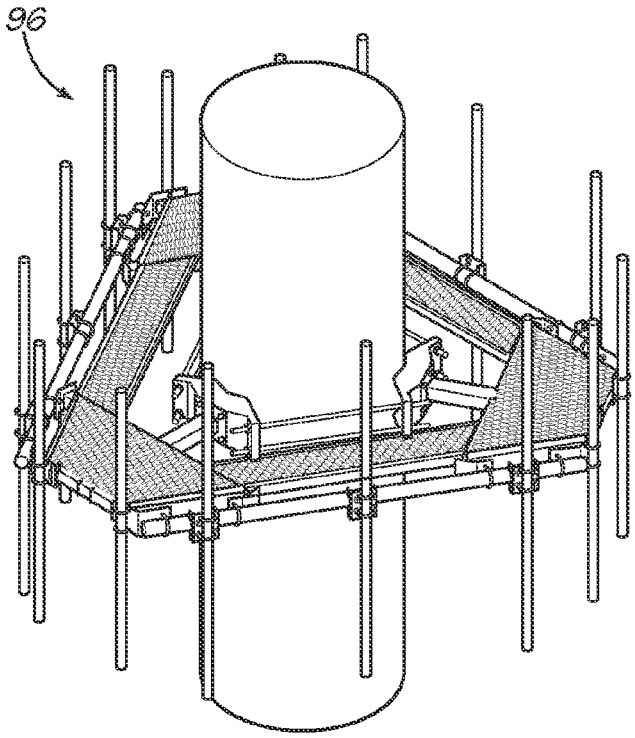

FIGS. 11A and 11B are diagrams of a fifth embodiment of a platform assembly 96. This embodiment is similar to the platform assembly 62 of FIG. 7. However, in FIG. 11, the platform assembly includes three side gratings 98, where each side grating 98 is configured to span between two platform structures 26. With the side gratings 98 installed, a portion of a gap between the platform structures 26 is bridged for added security. The side grating 98 may contain a unitary piece of metal or other material and may include a tread section for providing traction. The side gratings 98 may be configured to rest upon and be fastened to side L-beams 100. Each side L-beam 100 includes a section that backs to a section of the L-beam structure of the back arms 14 (FIG. 1). The adjacent back portions of the two L-beams may be welded together. A top section of each side L-beam 100 extends horizontally away from the respective back arm 18 and provides support for the side grating 98. The side grating 98 may have any suitable shape, such as a trapezoidal shape as shown.

Figure 12A:
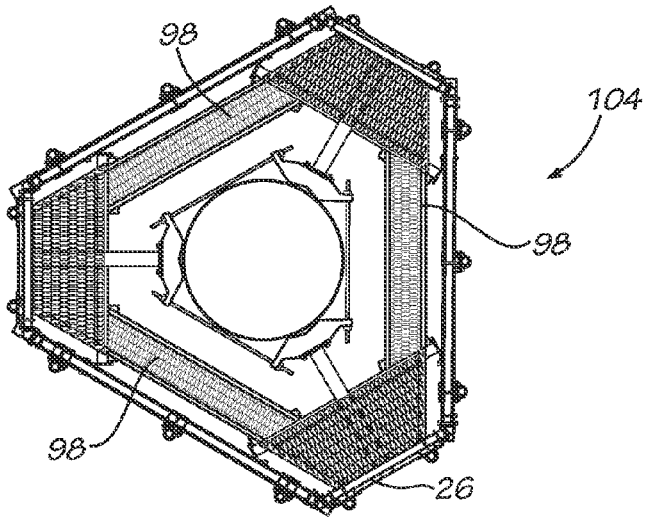
FIGS. 12A and 12B are diagrams of a sixth platform assembly according to various embodiments.
Figure 12B:
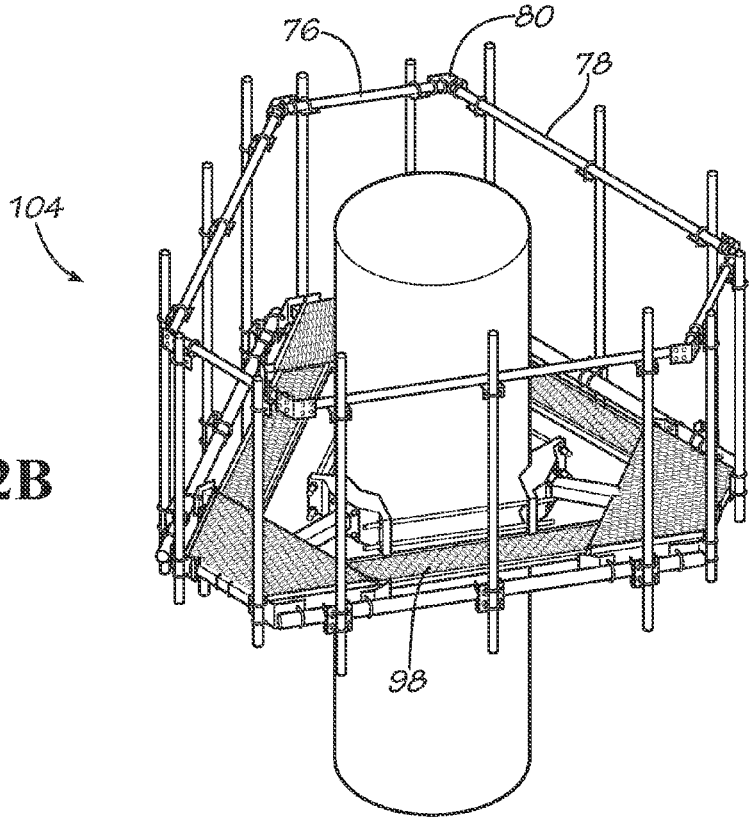

FIGS. 12A and 12B are diagrams of a sixth embodiment of a platform assembly 104. The platform assembly 104 in this embodiment may be arranged in a similar manner as the embodiment of FIGS. 8A and 8B with respect to the platform structures 26, side pipes 46-S, antenna supports 56, front handrails 76, and side handrails 78. Also, the platform assembly 104 in this embodiment may be arranged in a similar manner as the embodiment of FIGS. 11A and 11B with respect to the side gratings 98.

Figure 13A:
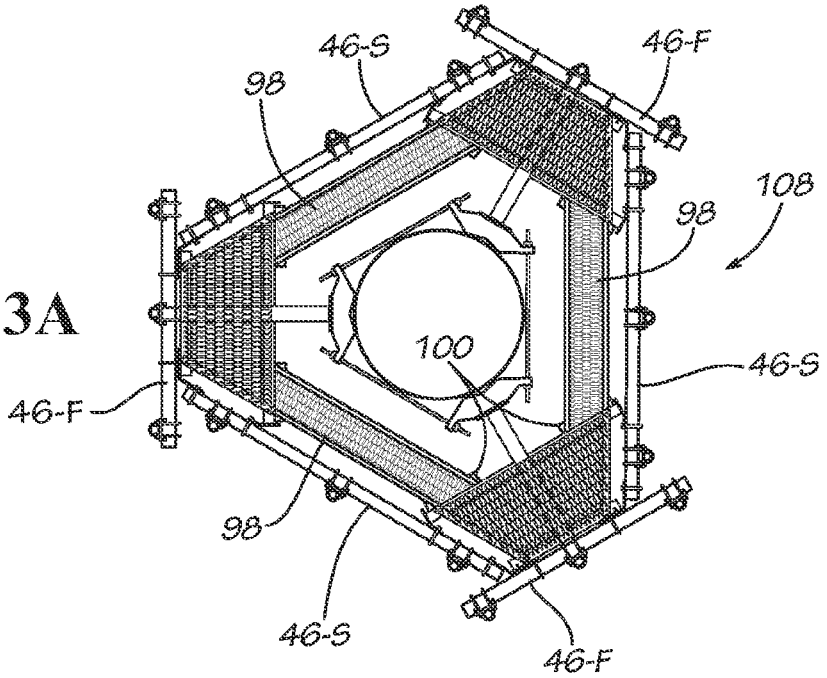
FIGS. 13A and 13B are diagrams of a seventh platform assembly according to various embodiments.
Figure 13B:
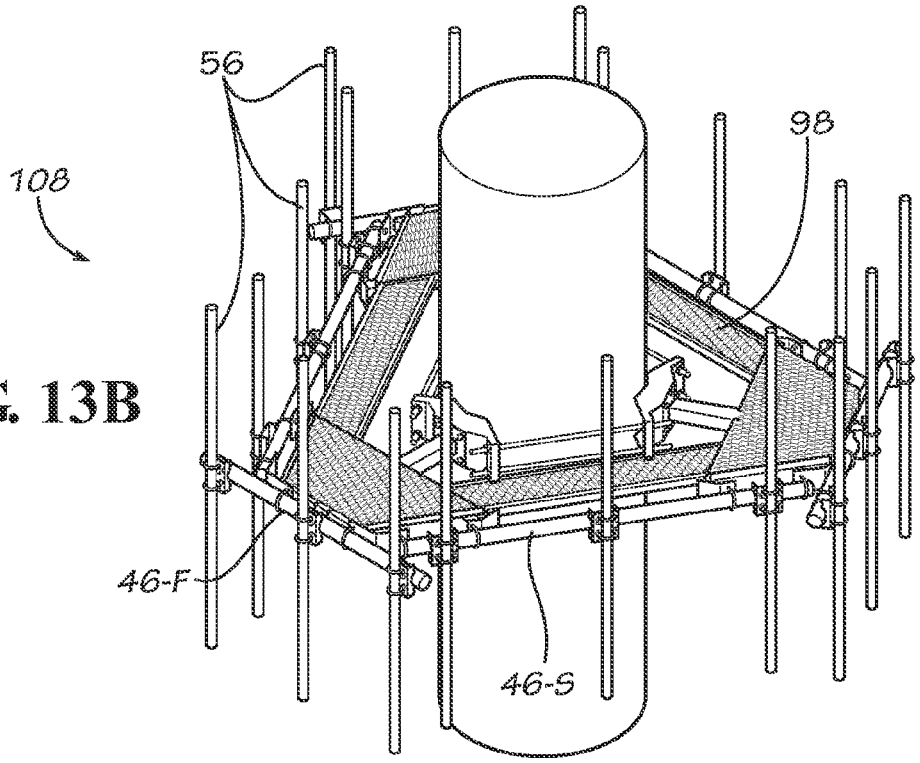

FIGS. 13A and 13B are diagrams of a seventh embodiment of a platform assembly 108 according to various embodiments. The platform assembly 108 in this embodiment may be arranged in a similar manner as the embodiment of FIGS. 9A and 9B with respect to the platform structures 26, front pipes 46-F, side pipes 46-S, and antenna supports 56. Also, the platform assembly 108 in this embodiment may be arranged in a similar manner as the embodiment of FIGS. 11A and 11B with respect to the side gratings 98.

Figure 14A:
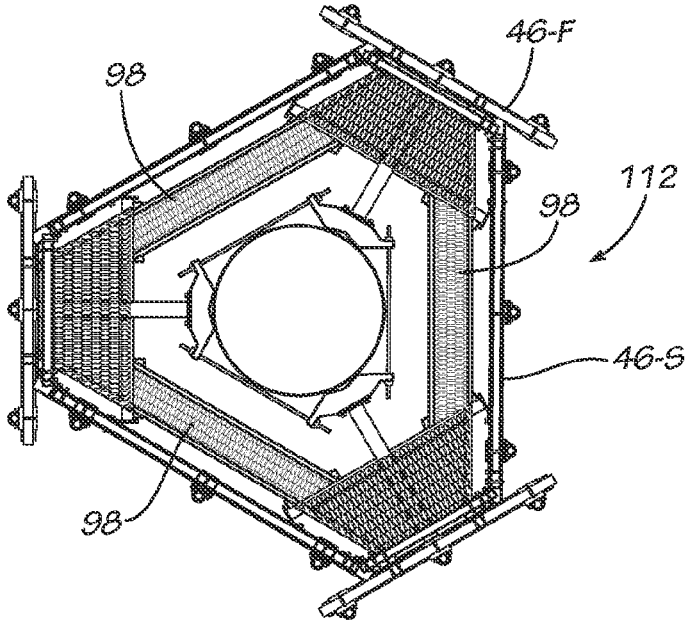
FIGS. 14A and 14B are diagrams of an eighth platform assembly according to various embodiments.
Figure 14B:
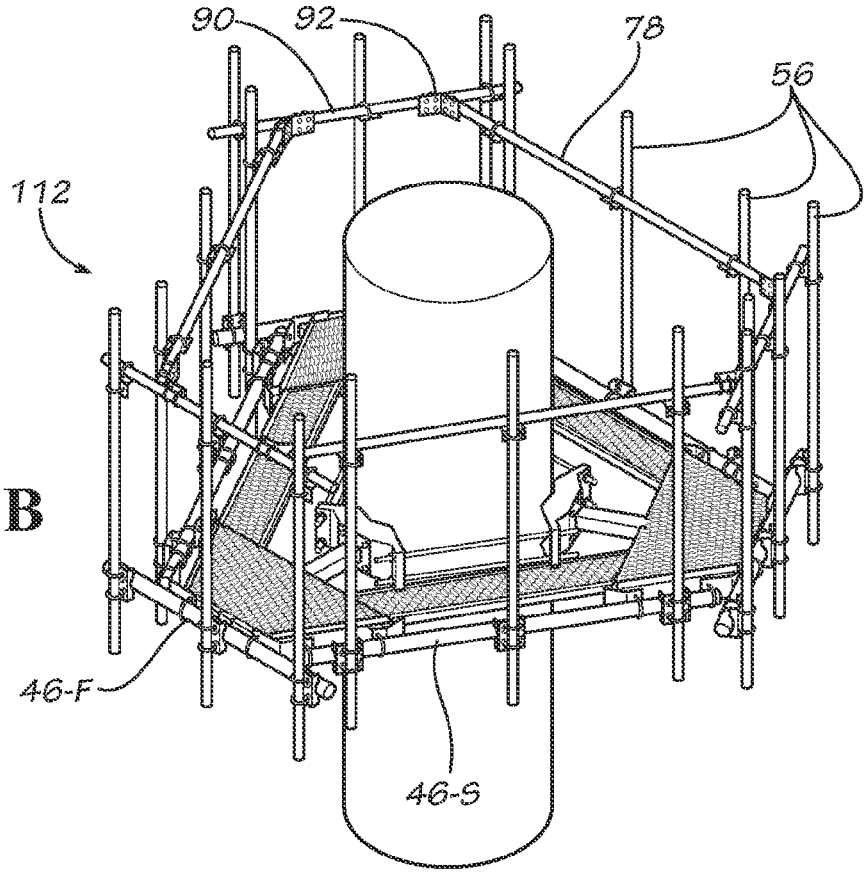

FIGS. 14A and 14B are diagrams of an eighth embodiment of a platform assembly 112. The platform assembly 112 in this embodiment may be arranged in a similar manner as the embodiment of FIGS. 10A and 10B with respect to the platform structures 26, front pipes 46-F, side pipes 46-S, antenna supports 56, front handrails 90, and side handrails 78. Also, the platform assembly 112 in this embodiment may be arranged in a similar manner as the embodiment of FIGS. 11A and 11B with respect to the side gratings 98.

Figure 15:
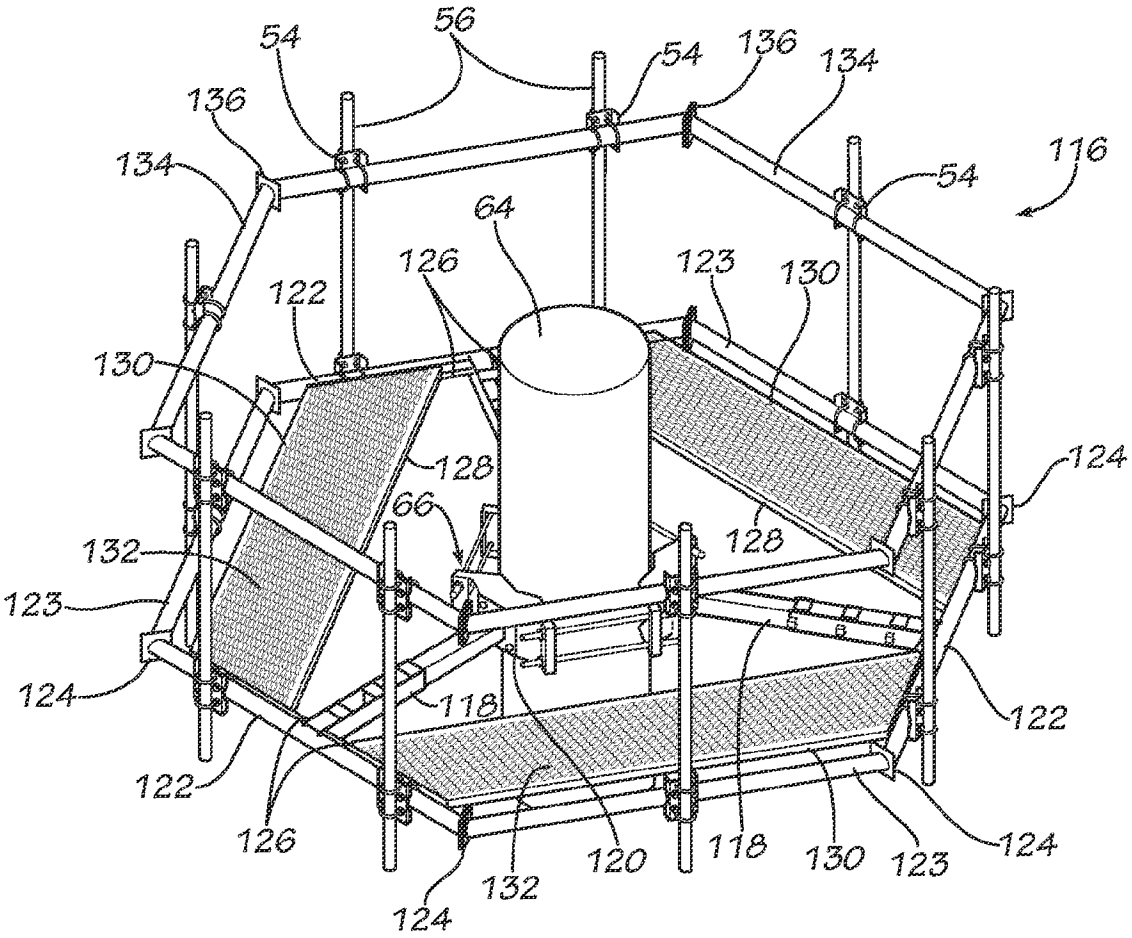
FIG. 15 is an isometric view of a hexagonal platform assembly according to various embodiments.

FIG. 15 is a diagram of an embodiment of a hexagonal platform assembly 116. The hexagonal platform assembly 116, according to some embodiments, includes the brace structure 66 mounted on the pole 64. Attached to the brace structure 66 is a radial beam 118 having a mounting plate 120 that attaches to the brace structure 66. As illustrated, the hexagonal platform assembly 116 includes three radial beams 118, which may have a longitudinal axis extending substantially radially from the pole 64. The three radial beams 118 are connected to a middle section of the three respective load pipes 122. Ends of three pipe segments 123 are connected to ends of adjacent load pipes 122 so as to substantially form a hexagon. At the ends of the load pipes 122 and pipe segments 123 are end plates 124 for connection (e.g., by welding) the ends of the load pipes 122 with the ends of the pipe segments 123.

Attached to each of the load pipes 122 is a pair of L-beam arms 126 extending in opposite directions from the radial beam 118 along a middle portion of the length of the load pipes 122. Each of the L-beam arms 126 is configured to support one end of an elongated L-beam 128 and one end of an outer L-beam 130. The other ends of the elongated L-beams 128 and outer L-beams 130 are supported by other L-beam arms 126 on other load pipes 122. An elongated grating 132 is mounted on each pair of elongated L-beams 128 and outer L-beams 130.

Mounting hardware 54 may be used to connect antenna supports 56 with the load pipes 122 and pipe segments 123. In some embodiments, two antenna supports 56 may be mounted on each of the load pipes 122 and one antenna support 56 may be mounted on each of the pipe segments 123, for a total of nine antennas. Six sections of handrails 134 are connected together by end plates 136 and are connected to the antenna supports 56 by mounting hardware 54. Each of the antenna supports 56 may be connected to the load pipes 122, pipe segments 123, and handrails 134 by connecting the mounting hardware 54 to the load pipes 122, pipe segments 123, and handrails 134 using U-bolts and by connecting the antenna supports 56 to the mounting hardware 54 using U-bolts.

Figure 16:
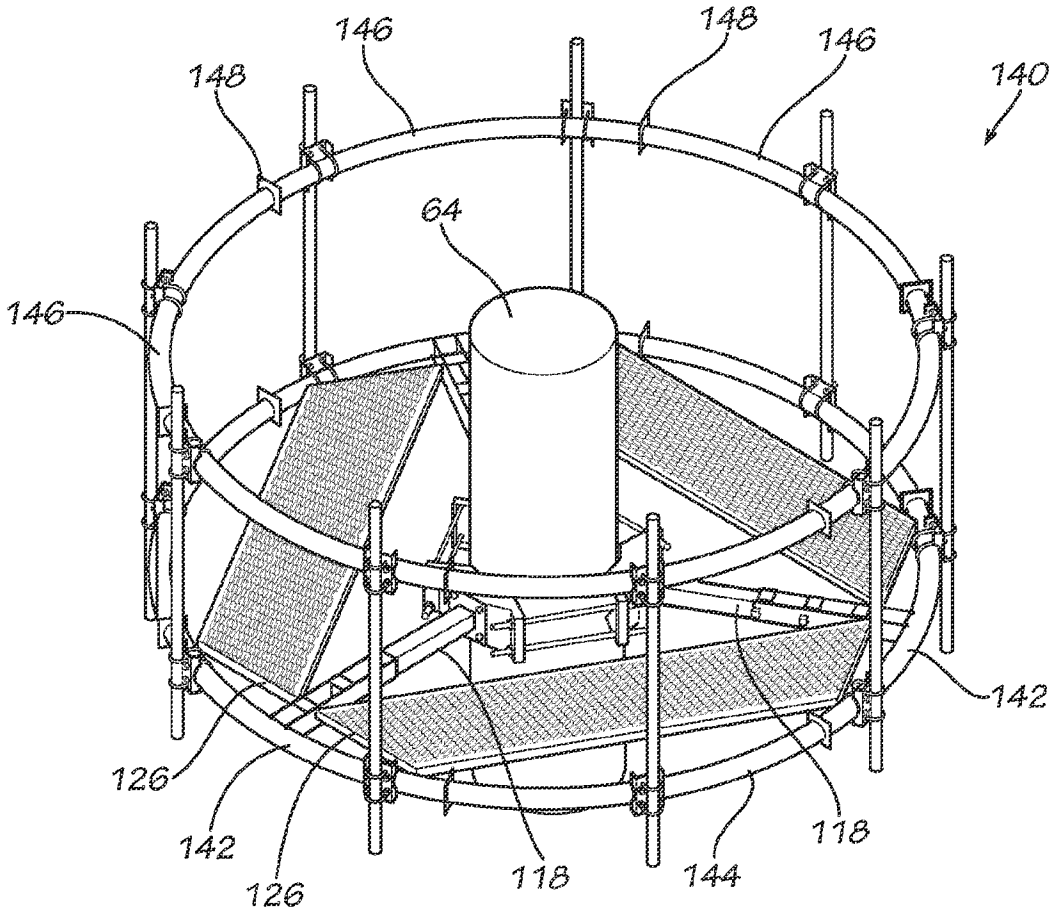
FIG. 16 is an isometric view of a circular platform assembly according to various embodiments.

FIG. 16 is a diagram of an embodiment of a circular platform assembly 140. The circular platform assembly 140 includes many similar aspects as the hexagonal platform assembly 116 of FIG. 15. However, instead of the load pipes and pipe segments being formed in a hexagon, load pipes 142 and pipe segments 144 are configured in a circular pattern. Also, instead of the L-beam arms 126 being positioned against the load pipes as in FIG. 15, the L-beam arms 126 are supported at one end with the radial beam 118 and at the other end by the load pipe 142. Another difference between the hexagonal platform assembly 116 and the circular platform assembly 140 is that the handrails 146 shown in FIG. 16 are arranged in a circular pattern while the handrails 134 shown in FIG. 15 form a hexagon. The handrails 146 are connected together using end plates 148, which may be welded together.

According to various implementations of the present disclosure, a platform assembly may comprise first, second, and third platform structures 26. Each platform structure 26 may comprise a radial beam 12 extending substantially horizontally away from a vertical support structure 64 (e.g., a tower) and a grating 28 configured to support the weight of a human. Each platform structure 26 further comprises a first front plate 22L having a front facing portion 32 and an angled portion 42, a second front plate 22R having a front facing portion 32 and an angled portion 42, a first side plate 24L having a side facing portion and an angled portion, and a second side plate 24R having a side facing portion and an angled portion. A first side pipe 46-S having a first end and a second end may be configured such that its first end is connected to the angled portion 42 of the first front plate 22L of the first platform structure 26 and the angled portion of the first side plate 24L of the first platform structure 26. The second end of the first side pipe 46-S may be connected to the angled portion 42 of the second front plate 22R of the second platform structure 26 and the angled portion of the second side plate 24R of the second platform structure 26. A second side pipe 46-S having a first end and a second end may be configured such that its first end is connected to the angled portion 42 of the first front plate 22L of the second platform structure 26 and the angled portion of the first side plate 24L of the second platform structure 26. The second end of the second side pipe 46-S may be connected to the angled portion 42 of the second front plate 22R of the third platform structure 26 and the angled portion of the second side plate 24R of the third platform structure 26. A third side pipe 46-S having a first end and second end may be configured such that its first end is connected to the angled portion 42 of the first front plate 22L of the third platform structure 26 and the angled portion of the first side plate 24L of the third platform structure 26. The second end of the third side pipe 46-S may be connected to the angled portion 42 of the second front plate 22R of the first platform structure 26 and the angled portion of the second side plate 24R of the first platform structure 26.

In some embodiments, the antenna supports 56 may be arranged in a substantially vertical configuration, where each antenna support 56 is configured to support an RF antenna. The platform assembly may further comprise first, second, and third front pipes 46-F. The first front pipe 46-F may be connected to the front facing portion 32 of the first front plate 22L of the first platform structure 26 and the front facing portion 32 of the second front plate 22R of the first platform structure 26. The second front pipe 46-F may be connected to the front facing portion 32 of the first front plate 22L of the second platform structure 26 and the front facing portion 32 of the second front plate 22R of the second platform structure 26. The third front pipe 46-F may be connected to the front facing portion 32 of the first front plate 22L of the third platform structure 26 and the front facing portion 32 of the second front plate 22R of the third platform structure 26.

Each of the first, second, and third front pipes 46-S may be configured to support multiple antenna supports 56, each antenna support being arranged in a substantially vertical configuration and configured to support an RF antenna. In some embodiments, the platform assembly may further comprise first, second, and third side railings 78 and first, second, and third front railings 76, 90. The first side railing 78 may be connected to the antenna supports 56 connected to the first side pipe 46-S, the second side railing 78 may be connected to the antenna supports 56 connected to the second side pipe 46-S, and the third side railing 78 may be connected to the antenna supports 56 connected to the third side pipe 46-S. The first front railing 76, 90 may be connected to the antenna supports 56 connected to the first front pipe 46-F, the second front railing 76, 90 may be connected to the antenna supports 56 connected to the second front pipe 46-F, and the third front railing 76, 90 may be connected to the antenna supports 56 connected to the third front pipe 46-F.

The platform assembly in these embodiments may further comprise first, second, third, fourth, fifth, and sixth antenna supports 56. The first antenna support 56 may be connected to the front facing portion 32 of the first front plate 22L of the first platform structure 26 and the second antenna support 56 may be connected to the front facing portion 32 of the second front plate 22R of the first platform structure 26. The third antenna support 56 may be connected to the front facing portion 32 of the first front plate 22L of the second platform structure 26 and the fourth antenna support 56 may be connected to the front facing portion 32 of the second front plate 22R of the second platform structure 26. The fifth antenna support 56 may be connected to the front facing portion 32 of the first front plate 22L of the third platform structure 26 and the sixth antenna support 56 may be connected to the front facing portion 32 of the second front plate 22R of the third platform structure 26.

Each platform structure 26 may be configured to support the weight of a human independently of the other platform structures 26. In some embodiments, however, the side pipes 46-S provide additional support and stability. The platform assembly may further comprise first, second, and third side railings 78. The first side railing 78 may be connected to the antenna supports 56 connected to the first side pipe 46-S, the second side railing 78 may be connected to the antenna supports 56 connected to the second side pipe 46-S, and the third side railing 78 may be connected to the antenna supports 56 connected to the third side pipe 46-S.

In some embodiments, the platform assembly may further comprise first, second, and third side grating 98. The first side grating 98 may be connected between the first and second platform structures 26, the second side grating 98 may be connected between the second and third platform structures 26, and the third side grating 98 may be connected between the third and first platform structures 26.

According to various embodiments, the platform assembly may be configured to support up to fifteen antenna supports 56, and according to some embodiments, the platform assembly may be configured to support up to eighteen antenna supports 56. The elements connected to each other in these embodiments may be connected by, among others, U-bolts, hex nuts, and various types of mounting and support hardware when two cylindrical elements or other types of elements are to be connected together.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

We claim:

1. A platform assembly comprising:

first, second, and third trapezoidal platform structures, each platform structure respectively including a radial beam and a grating supported by the radial beam, the radial beam constructed to connect to and extend substantially horizontally away in a radial direction from a vertical support structure and to support a weight of a human, each platform structure respectively defining at least four vertical mounting plate surfaces arranged in three intersecting vertical mounting planes, including a first front vertical mounting plate surface spaced apart from a second front vertical mounting plate surface defined in at least substantially co-planar relationship in a front vertical mounting plane of the three intersecting vertical mounting planes, the first front vertical mounting plate surface defining at least a first aperture positioned on a first side of the radial beam, the second front vertical mounting plate surface defining at least a second aperture positioned on an opposite second side of the radial beam, at least one first side vertical mounting plate surface defined in a first side vertical mounting plane of the three intersecting vertical mounting planes, and at least one second side vertical mounting plate surface defined in a second side vertical mounting plane of the three intersecting vertical mounting planes, wherein the front vertical mounting plane is perpendicular to the radial direction of the radial beam, the first aperture is configured to support a first antenna support configured to support a first vertical antenna, the second aperture is configured to support a second antenna support configured to support a second vertical antenna, and the first aperture is spaced a distance apart from the second aperture to provide for adequate spacing between the first and second vertical antennae to ensure proper function of the first and second vertical antennae;

a first side pipe having a first end and a second end, the first end of the first side pipe connected to the at least one first side vertical mounting plate surface of the first platform structure, and the second end of the first side pipe connected to the at least one second side vertical mounting plate surface of the second platform structure;

a second side pipe having a first end and a second end, the first end of the second side pipe connected to the at least one first side vertical mounting plate surface of the second platform structure, and the second end of the second side pipe connected to the at least one second side vertical mounting plate surface of the third platform structure;

a third side pipe having a first end and a second end, the first end of the third side pipe connected to the at least one first side vertical mounting plate surface of the third platform structure, and the second end of the third side pipe connected to the at least one second side vertical mounting plate surface of the first platform structure, wherein each one of said side pipes is respectively configured to support a plurality of antenna supports; and wherein the first, second, and third platform structures are connected together such that the front vertical mounting planes, the first side vertical mounting planes, and the second side vertical mounting planes of the first, second, and third platform structures are hexagonally arranged whereby the first side vertical mounting plane of each of the first, second, and third platform structures is coplanar with an adjacent second side vertical mounting plane of a directly adjacent platform structure of the first, second, and third platform structures.

2. The platform assembly of claim 1, wherein the front vertical mounting plate surfaces are each defined by a separate plate.

3. The platform assembly of claim 1, wherein each of the front vertical mounting plate surfaces is connected to the radial beam.

4. The platform assembly of claim 3, wherein each of the front vertical mounting plate surfaces is connected through one or more arms to the radial beam.

5. The platform assembly of claim 1, wherein the first front vertical mounting plate surface is connected through an angled plate to the at least one first side vertical mounting plate surface.

6. The platform assembly of claim 5, wherein the second front vertical mounting plate surface is connected through a second angled plate to the at least one second side vertical mounting plate surface.

7. The platform assembly of claim 1, wherein said platform assembly comprises a respective one of said first antenna support connected to each respective one of said first front vertical mounting plate surfaces, and a respective one of said second antenna support connected to each respective one of said second front vertical mounting plate surfaces.

8. The platform assembly of claim 1, wherein each one of the front vertical mounting plate surfaces is connected directly to one of the side vertical mounting plate surfaces through an angle.

9. The platform assembly of claim 1, wherein the at least one first side vertical mounting plate surface includes a first side forward vertical mounting plate surface and a first side rear vertical mounting plate surface defined in at least substantially co-planar relationship in the first side vertical mounting plane of the three intersecting vertical mounting planes, and wherein the at least one second side vertical mounting plate surface includes a second side forward vertical mounting plate surface and a second side rear vertical mounting plate surface defined in at least substantially co-planar relationship in the second side vertical mounting plane of the three intersecting vertical mounting planes.

10. The platform assembly of claim 1, wherein the antenna supports are arranged in a substantially vertical configuration, each antenna support configured to support a radio frequency antenna.

11. The platform assembly of claim 1, wherein the vertical support structure is a tower.

12. The platform assembly of claim 1, wherein the first platform structure is configured to support a weight of a human independently of the second and third platform structures, the second platform structure is configured to support a weight of a human independently of the first and third platform structures, and the third platform structure is configured to support a weight of a human independently of the first and second platform structures.

13. The platform assembly of claim 1, further comprising first, second, and third side rails, wherein the first side rail is connected to the plurality of antenna supports that are connected to the first side pipe, the second side rail is connected to the plurality of antenna supports that are connected to the second side pipe, the third side rail is connected to the plurality of antenna supports that are connected to the third side pipe.

14. The platform assembly of claim 1, further comprising first, second, and third side gratings, the first side grating connected between the first platform structure and the second platform structure, the second side grating connected between the second platform structure and the third platform structure, the third side grating connected between the third platform structure and the first platform structure.

15. The platform assembly of claim 1, further comprising 15 antenna supports connected to and supported by the platform structures.

16. The platform assembly of claim 1, wherein the first, second, and third side pipes are connected to the surfaces by U-bolts, nuts, and mounting hardware.

* * * * *